US008197223B2

(12) United States Patent
Kuttler et al.

(10) Patent No.: US 8,197,223 B2
(45) Date of Patent: Jun. 12, 2012

(54) METHOD OF OPERATING A FLUID WORKING MACHINE

(75) Inventors: Onno Kuttler, Cousland/Dalkeith (GB); Ken Kin-ho Lai, Edinburgh (GB)

(73) Assignees: Sauer-Danfoss ApS, Nordborg (DK); Artemis Intelligent Power Ltd., Midlothian, Scotland (GB)

( * ) Notice: Subject to any disclaimer, the term of this patent is extended or adjusted under 35 U.S.C. 154(b) by 0 days.

(21) Appl. No.: 12/740,789

(22) PCT Filed: Oct. 29, 2008

(86) PCT No.: PCT/DK2008/000385

§ 371 (c)(1),
(2), (4) Date: Aug. 12, 2010

(87) PCT Pub. No.: WO2009/056141

PCT Pub. Date: May 7, 2009

(65) Prior Publication Data

US 2010/0303638 A1 Dec. 2, 2010

(30) Foreign Application Priority Data

Nov. 1, 2007 (EP) ..... 07254331

(51) Int. Cl.
*F04B 49/06* (2006.01)
*F04B 7/00* (2006.01)

(52) U.S. Cl. ..... 417/53; 417/505

(58) Field of Classification Search ..... 417/53, 417/505, 290, 247, 423.14, 372, 405, 270, 417/278, 297, 315, 349, 506; 60/445; 251/129.01, 251/129.05, 129.08

See application file for complete search history.

(56) References Cited

U.S. PATENT DOCUMENTS

| | | | |
|---|---|---|---|
| 4,321,014 | A | 3/1982 | Eburn, Jr. et al. |
| 4,815,946 | A | 3/1989 | Cusack |
| 5,046,926 | A | 9/1991 | Deininger et al. |
| 5,186,612 | A | 2/1993 | Budzich |
| 5,190,446 | A | 3/1993 | Salter et al. |
| 5,921,759 | A | 7/1999 | Khan |
| 6,055,851 | A | 5/2000 | Tanaka et al. |
| 6,126,418 | A | 10/2000 | Sinnl |
| 6,283,724 | B1 | 9/2001 | Alaze et al. |
| 6,681,571 | B2 | 1/2004 | Bailey et al. |
| 2004/0105763 | A1 | 6/2004 | Kondo |
| 2006/0039795 | A1 | 2/2006 | Stein et al. |

(Continued)

FOREIGN PATENT DOCUMENTS

DE 4306377 A1 9/1994

(Continued)

OTHER PUBLICATIONS

International Search Report dated Feb. 2, 2009 from Serial No. PCT/DK2008/000385.

(Continued)

*Primary Examiner* — Karabi Guharay
*Assistant Examiner* — Elmito Breval
(74) *Attorney, Agent, or Firm* — McCormick, Paulding & Huber LLP

(57) ABSTRACT

When the fluid flow output of a synthetically commutated hydraulic pump is adapted to a given fluid flow demand, pulsations in the fluid output flow of the synthetically commutated hydraulic pump can occur. To avoid such pressure pulsations, it is suggested, to use a set of pre-calculated actuation patterns for actuating the electrically commutated valves of the synthetically commutated hydraulic pump.

14 Claims, 5 Drawing Sheets

U.S. PATENT DOCUMENTS

| | | | |
|---|---|---|---|
| 2009/0120086 | A1 | 5/2009 | Kuttler et al. |

FOREIGN PATENT DOCUMENTS

| | | | |
|---|---|---|---|
| EP | 0361927 | A1 | 4/1990 |
| EP | 0494236 | | 7/1992 |
| EP | 0577783 | | 1/1994 |
| EP | 1319836 | A2 | 6/2003 |
| EP | 1469237 | A1 | 10/2004 |
| EP | 1537333 | | 6/2005 |
| EP | 2055943 | A1 | 6/2009 |
| EP | 2055944 | A1 | 6/2009 |
| EP | 2055945 | A1 | 6/2009 |
| EP | 2055946 | A1 | 6/2009 |
| GB | 968452 | | 9/1964 |
| GB | 1374752 | | 11/1974 |
| WO | 9105163 | A1 | 4/1991 |
| WO | 2004025122 | A1 | 3/2004 |

OTHER PUBLICATIONS

International Search Report dated Feb. 2, 2009 from Serial No. PCT/DK2008/000382.

International Search Report dated Feb. 2, 2009 from Serial No. PCT/DK2008/000381.

International Search Report dated Feb. 2, 2009 from Serial No. PCT/DK2008/000386.

International Search Report dated Feb. 2, 2009 from Serial No. PCT/DK2008/000384.

0% to 16.7%/83.3% to 100%

0% to 20% / 80% to 100%

METHOD OF OPERATING A FLUID WORKING MACHINE

CROSS REFERENCE TO RELATED APPLICATIONS

This application is entitled to the benefit of and incorporates by reference essential subject matter disclosed in International Patent Application No. PCT/DK2008/000385 filed on Oct. 29, 2008 and EP Patent Application No. 07254331.7 filed Nov. 1, 2007.

FIELD OF THE INVENTION

The invention relates to a method of operating a fluid working machine, comprising at least one working chamber of cyclically changing volume, a high-pressure fluid connection, a low-pressure fluid connection and at least one electrically actuated valve connecting said working chamber to said high-pressure fluid connection and/or said low-pressure fluid connection, wherein the actuation of at least one of said electrically actuated valves is chosen depending on the fluid flow demand. The invention further relates to a fluid working machine, comprising at least one working chamber of cyclically changing volume, a high-pressure fluid connection, a low-pressure fluid connection, at least one electrically actuated valve, connecting said working chamber to said high-pressure fluid manifold and/or said low-pressure fluid connection and at least an electronic controller unit. Furthermore, the invention relates to a memory device intended to be used for the electronic controller of a fluid working machine of the previously mentioned type.

BACKGROUND OF THE INVENTION

Fluid working machines are generally used, when fluids are to be pumped or fluids are used to drive the fluid working machine in a motoring mode. The word "fluid" can relate to both gases and liquids. Of course, fluid can even relate to a mixture of gas and liquid and furthermore to a supercritical fluid, where no distinction between gas and liquid can be made anymore.

Very often, such fluid working machines are used, if the pressure level of a fluid has to be increased. For example, such a fluid working machine could be an air compressor or a hydraulic pump.

Generally, fluid working machines comprise one or more working chambers of a cyclically changing volume. Usually, for each cyclically changing volume, there is provided a fluid inlet valve and a fluid outlet valve.

Traditionally, the fluid inlet valves and the fluid outlet valves are passive valves. When the volume of a certain working chamber increases, its fluid inlet valve opens, while its fluid outlet valve closes, due to the pressure differences, caused by the volume increase of the working chamber. During the phase, in which the volume of the working chamber decreases again, the fluid inlet valve closes, while the fluid outlet valve opens due to the changed pressure differences.

A relatively new and promising approach for improving fluid working machines are the so-called synthetically commutated hydraulic pumps, also known as digital displacement pumps or as variable displacement pumps. Such synthetically commutated hydraulic pumps are known, for example, from EP 0494236 B1 or WO 91/05163 A1. In these pumps, the passive inlet valves are replaced by electrically actuated inlet valves. Preferably the passive fluid outlet valves are also replaced by electrically actuated outlet valves. By appropriately controlling the valves, a full-stroke pumping mode, an empty-cycle mode (idle mode) and a part-stroke pumping mode can be achieved. Furthermore, if inlet and outlet valves are electrically actuated, the pump can be used as a hydraulic motor as well. If the pump is run as a hydraulic motor, full stroke motoring and part-stroke motoring is possible as well.

A major advantage of such synthetically commutated hydraulic pumps is their higher efficiency, as compared to traditional hydraulic pumps. Furthermore, because the valves are electrically actuated, the output characteristics of a synthetically commutated hydraulic pump can be changed very quickly.

For adapting the fluid flow output of a synthetically commutated hydraulic pump according to a given demand, several approaches are known in the state of the art.

It is possible to switch the synthetically commutated hydraulic pump to a full-stroke pumping mode for a certain time, for example. When the synthetically commutated pump runs in a pumping mode, a high pressure fluid reservoir is filled with fluid. Once a certain pressure level is reached, the synthetically commutated pump is switched to an idle mode and the fluid flow demand is supplied by the high pressure fluid reservoir. As soon as the high pressure fluid reservoir reaches a certain lower threshold level, the synthetically commutated hydraulic pump is switched on again.

This approach, however, necessitates a relatively large high pressure fluid reservoir. Such a high pressure fluid reservoir is expensive, occupies a large volume and is quite heavy. Furthermore, a certain variation in the output pressure will occur.

So far, the most advanced proposal for adapting the output fluid flow of a synthetically commutated hydraulic pump according to a given demand is described in EP 1 537 333 B1. Here, it is proposed to use a combination of an idle mode, a part-stroke pumping mode and a full-stroke pumping mode. In the idle mode, no fluid is pumped by the respective working chambers to the high-pressure manifold. In the full-stroke mode, all of the usable volume of the working chamber is used for pumping fluid to the high-pressure side within the respective cycle. In the part stroke mode, only a part of the usable volume is used for pumping fluid to the high-pressure side in the respective cycle. The different modes are distributed among several chambers and/or among several successive cycles in a way, that the time averaged effective flow rate of fluid through the machine satisfies a given demand.

The controlling methods, which have been employed so far, had in common, that the control algorithm did the necessary calculations "online", i.e. during the actual use of the fluid working machine. For this, a variable, the so-called "accumulator" was used. The accumulator uses the fluid flow demand as the (main) input variable.

During the use of the fluid working machine, the value of the accumulator is checked and it is determined, whether a pumping stroke should be initiated, or not. In the next step, the accumulator is updated by adding the actual fluid flow demand. Furthermore, an appropriate value is subtracted from the accumulator, if some pumping work has been performed. Then, the loop is closed.

While these "online" controlling methods are relatively easy to implement, especially the controlling methods which are publicly known so far, they still suffer from certain limitations and draw-backs. A major issue is, that the time responsiveness, i.e., the time, the fluid working machine needs after a change in fluid flow demand to adjust its fluid flow output, can be quite long, especially under certain working conditions. Furthermore, under certain working conditions, huge variations in the output characteristics of the fluid working machine, and therefore strong pressure pulsations on the high-pressure side can be observed. Such pressure pulsations can be noticed in the behaviour of a hydraulic consumer (e.g. a hydraulic piston or a hydraulic motor). The pulsations can be noticed as a startstop-like movement (a "stiction" behaviour). The pressure pulsations can even lead to the destruction of certain parts of the hydraulic system.

To solve these problems, several improvements have been considered, addressing various issues. While some of these improvements are addressing some of the underlying problems quite efficiently, certain issues are still not addressed by these improvements.

A major imperfection is that when using "online-algorithms" with digital (i.e. discrete) controllers, numerical artefacts can never be completely avoided. This can be considered as some sort of a "Moiré"-effect for synthetically commutated hydraulic pumps. These numerical artefacts can occur especially when the fluid flow demand varies in a continuous way over time. In fact, quite often strong fluctuations in fluid flow output and even gaps, in which no pumping is performed at all for an extended period of time, can be observed when employing previously known "online" control algorithms.

SUMMARY OF THE INVENTION

It is therefore the object of the invention to suggest a method for operating a fluid working machine of the synthetically commutated type, which shows an improved fluid flow output characteristic. Furthermore an appropriate fluid working machine and a memory device is suggested.

To solve the problem it is suggested to modify a method of operating a fluid working machine of the aforementioned type in a way, that the actuation pattern of said electrically actuated valve is chosen from a set of pre-calculated actuation patterns.

The pre-calculated actuation patterns can be stored in a memory device. If a certain demand is requested, an appropriate actuation pattern can be selected from the stored set of actuation patterns. An actuation pattern can, in principle, be any series of no-stroke pumping cycles (idle mode), part-stroke pumping cycles and full-stroke pumping cycles. By pre-calculating the actuation patterns, a plethora of conditions can be considered and accounted for in the actuation patterns. For example, the actuation pattern to be used can be chosen in a way, that the fluid output flow is very smooth. This way, pressure pulsations can be avoided. Furthermore, by pre-calculating the actuation patterns, anti-aliasing methods can be used as well. This way, the aforementioned numerical artefacts (Moiré-Effect) can be reduced.

It is even possible to account for certain restrictions, which are pertinent to certain applications. It is, for example, possible, that in a certain application, a pressure peak, exceeding a certain threshold has to be avoided. However, in another application, a pressure ditch, caused by a gap in the fluid outflow pattern has to be avoided.

These and other restrictions can be considered when setting up the actuation patterns. The actuation patterns can be calculated by a computer program or can be set up manually. A manual set-up, however, can include assistance by a computer as well as modifying an actuation pattern, that has been pre-calculated by a computer program, by hand.

The fluid flow demand normally comes as an input from an operator, operating the machinery, in which the fluid working machine is installed. The fluid flow demand can be derived from the position of a command (e.g. a command lever, a paddle, a throttle, a joystick, the engine speed or the like). Of course it is also possible, that the fluid flow demand is determined by an electronic controller, for example. It is also possible, that the electronic controller determines (or influences) the fluid flow demand only under certain working conditions. This could be, for example, a shutdown under critical working conditions, or a reduction in power, because there is a risk of engine overheating.

The pre-calculated actuation patterns normally have to be calculated only once. Presumably, a pre-calculated set of actuation patterns can be even used for several applications. Also, a pre-calculated standard set of actuation patterns can be used for modifying the set of actuation patterns for another application. Therefore, a significant amount of effort to calculate the set of actuation patterns may be required. It is even possible to spend even several hours on calculating a single actuation pattern and/or using several hours of CPU-time to run a program for calculating an actuation pattern. Such an extensive use of time for the outflow characteristics would be impossible with "online" controlling algorithms.

Because it is not too problematic to use a relatively huge amount of resources for developing the set of actuation patterns "offline", and because memory devices (ROM chips, PROM chips, etc.) are inexpensively available, a large number of different actuation patterns for different fluid flow demands can be provided. If the number of different actuation patterns is sufficiently large, it is even possible, to round a certain input fluid flow demand to the next value, for which a pre-calculated actuation pattern is stored. If the steps between neighbouring fluid flow demands, for which an actuation pattern is stored, is small enough, this rounding will normally not be noticed by the operator of the machine. The steps are not necessarily of an arithmetic type with equal differences between two numbers. Instead, a geometric type could be used as well. In this case, the increments can be smaller at very low fluid flow demands and higher at higher fluid flow demands (geometric type). Also, the increments can be higher at very low fluid flow demands and lower at high fluid flow demands (logarithmic type). Also, it is possible to use a combination between logarithmic and geometric type: in this case, the increments are small, both at the low fluid flow demand, as well as at the high fluid flow demand side. At medium fluid flow demands, however, the increments would be higher.

However, to further improve the output characteristics it is preferred that a fluid flow demand, lying between two pre-calculated actuation patterns, is provided by interpolating between said two actuation patterns. This interpolation is normally done by an appropriate series, where said actuation patterns are following each other in time. If, for example an actuation pattern is stored for a 2% demand and for a 3% demand, and the actual fluid flow demand is 2.1%, the 2.1% demand can be satisfied on the long run, when a series of a single 3% actuation pattern and a following group of nine actuation patterns with 2% volume fraction is performed. With this interpolation, the number of different actuation patterns can be limited to an acceptable amount, but a very fine tuning by the operator is still possible.

It is also possible, to provide a fluid flow demand, lying between two pre-calculated actuation patterns by modifying at least one actuation angle (firing angle, actuation time, firing time) from its stored value. Doing this, a very smooth fine tuning can be provided. An advantage is, that the overall length of an actuation pattern, modified this way, remains constant. It is possible to designate certain individual pumping cycles within a pre-calculated actuation pattern. The information about the designated individual pumping cycles can be stored together with the actuation pattern. This stored information can even include parameter values, indicating how strong the angles of the designated individual pumping cycies have to be modified to modify the overall fluid flow output of the pre-calculated actuation pattern in a certain way.

In response to changes in the requested fluid flow demand, the transition between different actuation patterns can simply be done at the end of the previous actuation pattern. This approach for dealing with changes in demand is very simple. Since the entire pre-calculated actuation pattern must be completed first, errors between fluid flow demand and fluid flow output can be avoided even when changing the demand. The suggested method works best, if the actuation patterns are relatively short. This way, time delays between a change in demand and a change in fluid flow output can be on a negligible level. It is also possible to restrict the suggested method of transition to certain cases, e.g. if the stored actuation patterns are short or if the remaining part of the current actuation pattern is relatively short.

However, it can also prove to be advantageous, if the transition between different actuation patterns is done during the execution of the previous actuation pattern. This can be a very effective way to minimise delays between a change in demand and a change in fluid flow output, especially when some of the stored actuation patterns are very long. Of course, it is also possible to restrict the application of this modification only to cases, where the actuation patterns are long and/or the remaining part of the current actuation pattern is long. To minimise errors induced by the transition from one pattern to another, it is possible to choose an actuation pattern with a slightly higher or lower fluid flow in the next actuation pattern or the next actuation patterns.

Preferably, the transition error or any other problem caused by a transition between different actuation patterns can be addressed by starting the following actuation pattern from a position in-between said following actuation pattern. The actual position, from where the actuation pattern is started, can depend on the change in fluid flow demand, for example.

It is also possible to use a transition variable, being indicative of the smoothness of the transition between the different actuation patterns. This transition variable can sum up the difference between fluid flow demand and fluid flow output in a similar way as the accumulator variable is used in the state of the art. In particular, it is possible, that within the pre-calculated actuation patterns, a variable is provided, which is indicative of the discrepancy between fluid flow demand and actual fluid flow output at a certain point within the pre-calculated actuation pattern. A good transition point could be simply determined by choosing a point, where the difference between the actual running transition variable and the variable, stored within the pre-calculated actuation pattern, is as small as possible.

To make the fluid flow output as smooth as possible, it is preferred to use at least two or more different pumping/motoring fractions, particularly within the same pattern. In other words, in the pre-calculated actuation patterns, individual pumping cycles with at least two different pumping fractions are used. As a rule of thumb, the higher the number of different output fractions, the smoother the fluid outflow. In principle, the number of different volume fractions can be indefinite. However, the complexity of calculating the actuation pattern can increase with an increasing number of different pumping fractions. So it might be preferable, to restrict the number of different pumping fractions to a limited set of numbers, e.g. to two.

It is preferred, if certain part stroke volume fractions are excluded in the actuation patterns. It has been found that for part stroke pulses at or around 50%, the speed of the fluid leaving the working chamber is very high, because of the normally sinusoidal shape of the volume change of the working chamber. If the electrically commutated inlet valve is closed in this region to initiate a part stroke pumping cycle, this can result in the generation of noise and/or in a higher wear of the valve. Therefore, it is preferred to exclude such fractional values, if possible, when setting up the actuation patterns. The "forbidden" interval can start at 16.7% (⅙), 20%, 25%, 30%, 33.3% (⅓), 40%, 45% and can end at 55%, 60%, 65%, 66.7% (⅔), 70%, 75%, 80% and 86.1% (⅚). In particular, the limits of the "forbidden" interval can be chosen to be $$\frac{1}{n} \text{ and } \frac{n-1}{n},$$

where n=3, 4, 5 . . . . The upper and lower limit can be calculated by using a different value for n. It is also possible to restrict this exclusion only to a certain set of actuation pattern. If, for example, a certain fluid flow demand range can only be reasonably provided with an actuation pattern, comprising the "forbidden" interval, it is possible to accept the mentioned disadvantages, for getting a better fluid output behaviour. This size of the "forbidden area" can be dependent on the shaft speed as well.

When setting up the pre-calculated patterns, not only the overall fluid output should be considered, but in addition, the distribution of the pumping/motoring strokes within an actuation pattern should be arranged in a way, that a smooth fluid flow output during the execution of said actuation pattern is supported. This smooth output characteristics can be achieved by an appropriate selection of pumping fractions, an appropriate arrangement of the individual pumping cycles and by an appropriate spacing between individual pumping cycles.

When pre-calculating the actuation patterns, it can be advantageous, if the time dependent fluid output flow of the individual pumping/motoring strokes is considered for the pre-calculated actuation patterns. For example, fluid flow output peaks can be avoided, if no part stroke pulse is initiated during the high output flow phase of the previously initiated full stroke or part stroke pulse.

Furthermore, a fluid working machine of the aforementioned type is suggested, which is characterised in that the electronic controller unit is designed and arranged in a way, that the electronic controller unit performs a method according to one or more aspects of the previously described method. If a plurality of working chambers is present, a high-pressure fluid manifold and/or a low-pressure fluid manifold can be used.

Preferably, the fluid working machine comprises at least a memory device storing at least one pre-calculated actuation pattern.

In addition, a memory device is suggested, storing at least one pre-calculated actuation pattern for performing at least an aspect of the previously described method.

The fluid working machine and the memory device can be modified in analogy to the previously described embodiments of the suggested method. The objects and advantages of the respective embodiments are analogous to the respective embodiments of the described method.

The invention will become clearer when considering the following description of embodiments of the present invention, together with the enclosed figures.

DETAILED DESCRIPTION OF THE PREFERRED EMBODIMENTS

Figure 1:
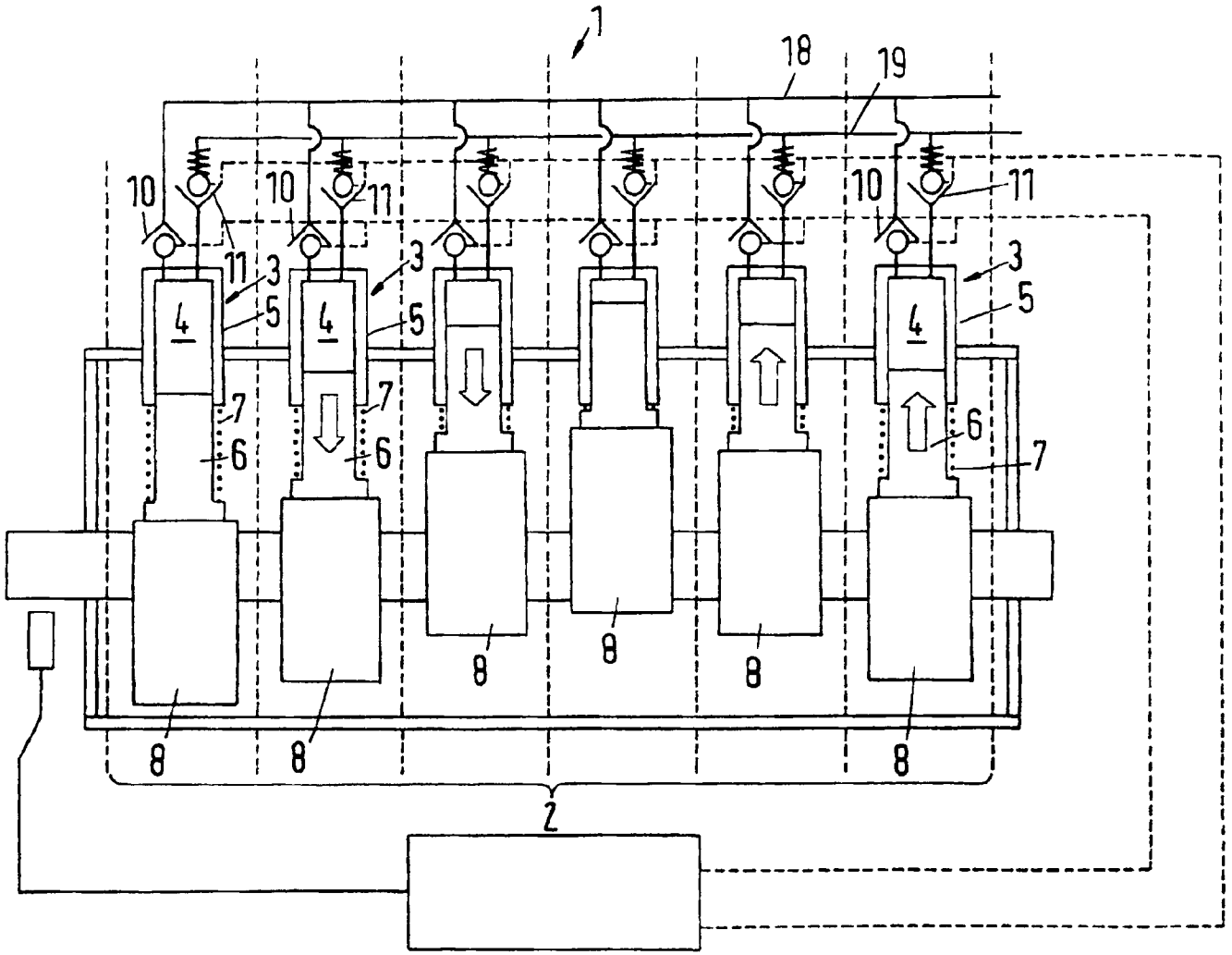
FIG. 1: shows a schematic diagram of a synthetically commutated hydraulic pump with six cylinders.

In FIG. 1, an example of a synthetically commutated hydraulic pump 1, with one bank 2, having six cylinders 3 is shown. Each cylinder has a working space 4 of a cyclically changing volume. The working spaces 4 are essentially defined by a cylinder part 5 and a piston 6. A spring 7 pushes the cylinder part 5 and the piston 6 apart from each other. The pistons 6 are supported by the eccentrics 8, which are attached off-centre of the rotating axis of the same rotatable shaft 9. In the case of a conventional radial piston pump ("wedding-cake" type pump), multiple pistons 6 can also share the same eccentric 8. The orbiting movement of the eccentrics 8 causes the pistons 6 to reciprocally move in and out of their respective cylinder parts 5. By this movement of the pistons 6 within their respective cylinder parts 5, the volume of the working spaces 4 is cyclically changing.

In the example shown in FIG. 1, the synthetically commutated hydraulic pump 1 is of a type with electrically actuated inlet valves 10 and electrically actuated outlet valves 11. Both inlet valves 10 and outlet valves 11 are fluidly connected to the working chambers 4 of the cylinders 3 on one side. On their other side, the valves are fluidly connected to a low pressure fluid manifold 18 and a high pressure fluid manifold 19, respectively.

Because the synthetically commutated hydraulic pump 1 comprises electrically actuated outlet valves 11, it can also be used as a hydraulic motor. Of course, the valves, which are inlet valves during the pumping mode, will become outlet valves during the motoring mode and vice-versa.

Of course, the design could be different from the example shown in FIG. 1, as well. For example, several banks of cylinders could be provided for. It's also possible that one or several banks 2 show a different number of cylinders, for example four, five, seven and eight cylinders. Although in the example shown in FIG. 1, the cylinders 3 are equally spaced within a full revolution of the rotatable shaft 9, i.e. 60° out of phase from each other, the cylinders 3 could be spaced unevenly, as well. Another possible modification is achieved, if the number of cylinders in different banks 2 of the synthetically commutated hydraulic pump 1 differ from each other. For example, one bank 2 might comprise six cylinders 3, while a second bank 2 of the synthetically commutated hydraulic pump 1 comprises just three cylinders 3. Furthermore, different cylinders can show different displacements. For example, the cylinders of one bank could show a higher displacement, as compared to the displacement of the cylinders of another bank.

Of course, not only piston and cylinder pumps are possible. Instead, other types of pumps can take advantage of the invention as well.

Figure 2:
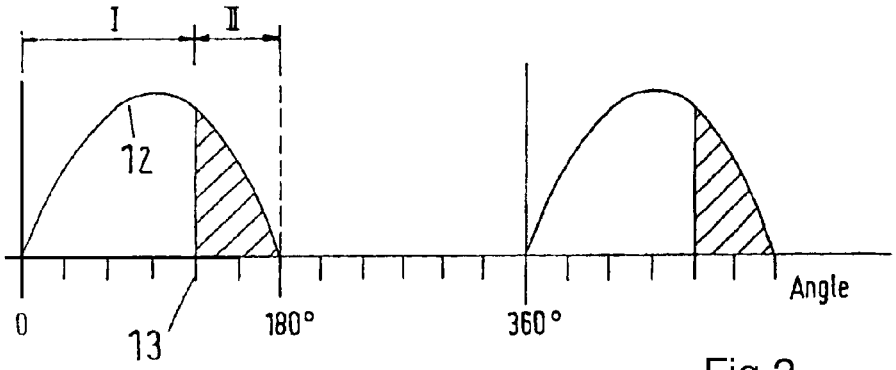
FIG. 2: illustrates the part stroke pumping concept.

In FIG. 2 the fluid output flow 12 of a single cylinder 3 is illustrated. In FIG. 2 a tick on the abscissa indicates a turning angle of 30° of the rotable shaft 9. At 0° (and of course at 360°, 720° and so on) the working chamber 4 of the respective cylinder 3 starts to decrease in volume. In the beginning, the electrically actuated inlet valve 10 remains in its open position. Therefore, the fluid, being forced outwards of the working chamber 4 will leave the cylinder 3 through the still open inlet valve 10 towards the low pressure fluid manifold. Therefore, in time interval l, a "passive pumping" is done, i.e. the fluid, entering and leaving the working chamber 4 is simply moved back to the low pressure fluid manifold 18 and no effective pumping towards the high pressure side of the hydraulic pump 1 is performed. In the example shown in FIG. 2, the firing angle 13 is chosen to be at 120° rotation angle of the rotable shaft 9 (and likewise 480°, 840°, etc.). At firing angle 13, the electrically commutated valve 10 is closed by an appropriate signal. Therefore, the remaining fluid in working chamber 4 cannot leave the cylinder 3 via the inlet valve 10 anymore. Therefore, pressure builds up, which will eventually open the outlet valve 11 and push the fluid towards the high pressure manifold. Therefore, time interval II can be expressed as an "active pumping" interval, i.e., the hydraulic fluid leaving the working chamber 4 will leave the cylinder 3 towards the high pressure fluid manifold. Hence, effective pumping is performed by the hydraulic pump 1. Once the piston 6 has reached its top dead center (or slightly afterwards) at 180° (540°, 900° etc.), outlet valve 11 will close automatically under the force of the closing spring, and inlet valve 10 will be opened by the underpressure, created in the working chamber 4, when the piston 6 moves downwards. Now the expanding working chamber 4 will suck in hydraulic fluid via inlet valve 10. In the example of FIG. 2, an effective pumping of 25% of the available volume of working chamber 4 is performed.

Figure 3:
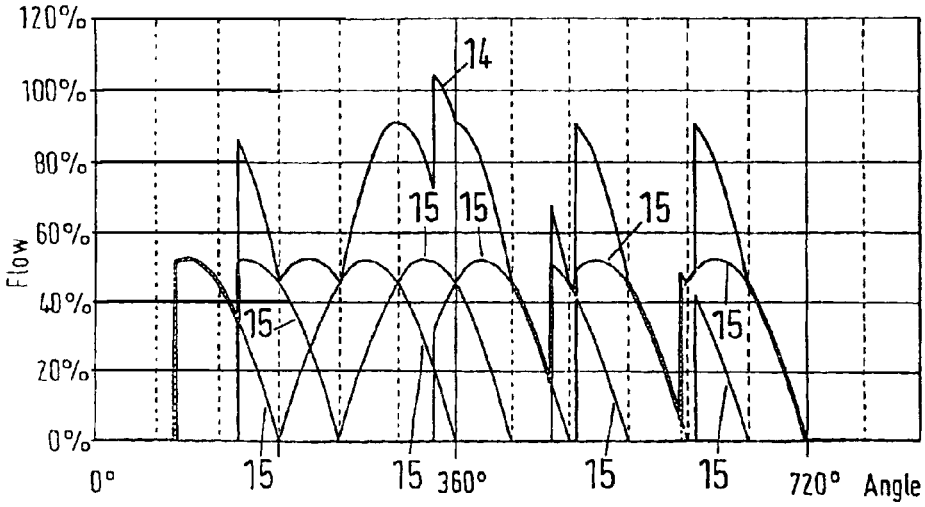
FIG. 3: illustrates, how an output fluid flow is generated by the individual output flow of several cylinders.

FIG. 3 illustrates, how a series of single pulses 15 of different volume fractions (including full stroke cycles and no-stroke cycles) can be combined to generate a certain total output flow 14. By choosing an actuation pattern, wherein the number of pumping cycles as well as the pumping volume fraction of each individual pumping stroke 15 can be varied, an unlimited number of output fluid flow rates can be achieved on the time average. The total fluid output flow 14 of FIG. 3 is not necessarily of a shape, that is likely to be used as an actuation pattern for real applications. However, it is a good example, on how the fluid output flow 15 of individual cylinders sums up to the total fluid output flow of the hydraulic pump.

In the following, a possible way to generate a pre-calculated actuation pattern is presented. To simplify the discussion, the presentation will be restricted to only two different volume pumping fractions, which are set to a 16% and 100% pumping volume fraction. However, it is clear to a person skilled in the art, that it is possible to set up an actuation pattern with more than two different pumping volume fractions and/or with different values of volume pumping fractions. Of course, the presentation can be applied likewise, if the fluid working machine is used for motoring. In this context, it should be pointed out that for synthetically commutated hydraulic pumps, employing a digital controller, all periods are necessarily quantised to a certain degree.

Figure 4A:
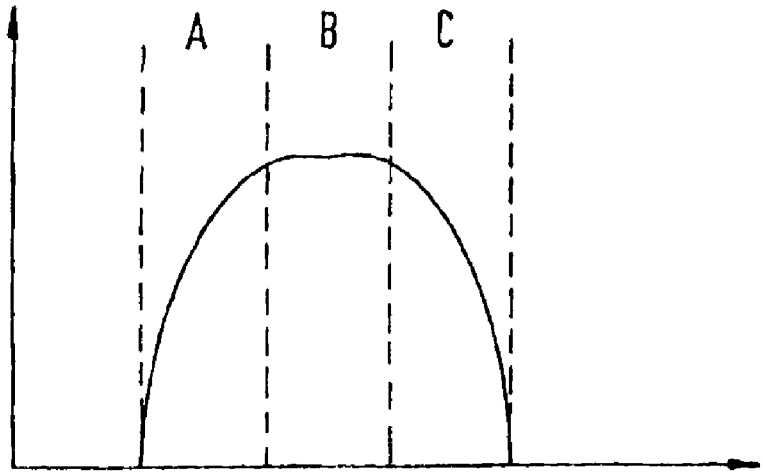
FIG. 4*a,b*: illustrates the different time lengths of different pumping fractions.

Assuming a repetitive sequence, composed of k different basic building blocks, the flow balance equation is $$\sum_{i=0}^{k} f_i \cdot n_i = d \cdot \sum_{i=0}^{k} n_i \cdot l_i,$$

where d is the fluid flow demand, $n_i$ denotes the number of instances of block i in the sequence, $f_i$ is the volume fraction for the respective pumping cycle and $l_i$ denotes the length of block i itself in terms of decision points. Using block length variable $l_i$, one is able to model the fact, that a pumping cycle with a high volume pumping fraction takes longer to complete than a pumping cycle with a lower pumping volume fraction. The block length $l_i$ can bear arbitrary units. The difference in length $l_i$ is illustrated in FIG. 4. In FIG. 4*a*, a full stroke pumping cycle with f=100% and l=3 is depicted. The equivalent fraction $$\frac{f}{l} = 33.3\%.$$

Figure 4B:
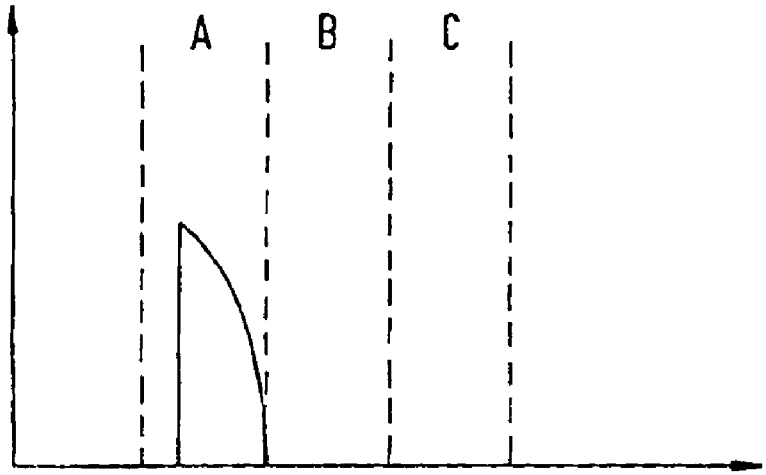
FIG. 4*c* shows an illustrative example for the use of composite blocks.

Likewise, in FIG. 4*b* a part stroke pumping cycle with a fraction f=16% is shown. The length l=1 and the equivalent fraction $$\frac{f}{l} = 16\%.$$

Using this block-length modelling, complicated constraints on pulse sequencing can be considered. For example, it is possible, to prohibit part stroke pulses during a phase of high fluid flow output of a previously initiated full stroke pulse (interval B in FIG. 4*a*). In particular, numerical solving techniques could be used for this purpose.

Figure 4C:
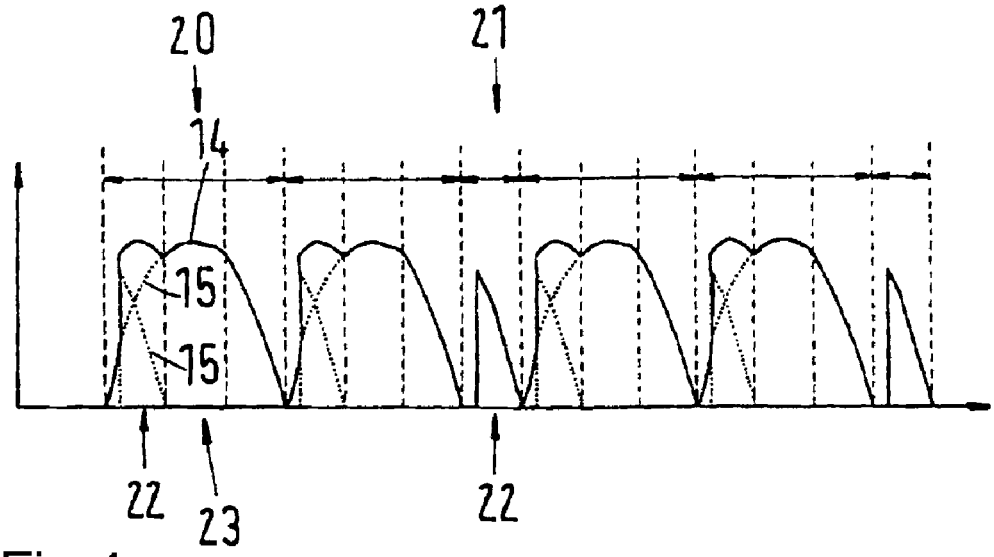

In FIG. 4*c* an illustrative example for the use of such composite blocks is shown. Along the abscissa, the progressing time is shown. As can be seen from FIG. 4*c*, the sequence consists of two composite blocks 20 and one single block 21. The composite block 20 consists of a single 16% pulse 22 and a single 100% pulse 23. The shapes of the individual pulses 22, 23 are indicated by the dotted lines 15. The overall fluid output flow is shown by solid line 14. The single block 21 consists of single 16% pulses 22.

Of course, it is possible to neglect the different pulse lengths l if all pulses are assumed to be of the same length and/or are assumed to last for only one decision. This way, "on-top" spikes like the total fluid output flow spikes around 140° or 340° in FIG. 3 can be avoided. In this case, l can be omitted in the basic flow balance equation.

Having only two different pumping volume fractions $f_1$, $f_2$, only two basic building blocks are required and the flow balance equation can be solved analytically (However, even with a larger number of different volume ratios, and hence a larger number of basic building blocks, the flow balance equation can still be solved at least numerically).

For a given demand d, wherein the two basic blocks are each specified with f and l, the relative ratio between the number of occurrences $n_1$, $n_2$ of each of the two blocks is $$\frac{n_1}{n_2} = \frac{(d \cdot l_2 - f_2)}{(f_1 - d \cdot l_1)}$$

To simplify the ratio, one can use the greatest common factor (gcf), so that we will get for $$n_1 = \frac{(d \cdot l_2 - f_2)}{gcf(d \cdot l_2 - f_2,\ f_1 - d \cdot l_1)}$$

$$n_2 = \frac{(f_1 - d \cdot l_1)}{gcf(d \cdot l_2 - f_2,\ f_1 - d \cdot l_1)}$$

Therefore, to satisfy a demand of 25% using 100% full stroke over a length of three decisions and 16% part stroke over a length of one decision, we have to use d=25%

$f_1$=100%

$l_1$=3

$f_2$=16%

$l_2$=1

Inserting this into the previous formulas, we will get $n_1$=9 and $n_2$=25. Therefore, the sequence will have to be composed of 9 full stroke pumping cycles over a length of three decisions and 25 part stroke cycles with a 16% volume fraction over a length of one decision.

Having established the number of occurrences of each basic building block, it is still necessary, to distribute them over time in an optimum way. This can be done in an iterative way as follows:

If $P_1$ denotes a first block 1 and $P_2$ denotes a second block 2, the sequence can be described as $n_1 \cdot P_1 + n_2 \cdot P_2$. Now, two integer variables q and r are defined, which will determine the next step in the iteration.

$$\text{If } n_1 > n_2, \text{ then}$$

$$q = \left\lfloor \frac{n_1}{n_2} \right\rfloor \text{ and } r = n_1 \bmod n_2, \text{ while}$$

$$\text{if } n_2 > n_1, \text{ then}$$

$$q = \left\lfloor \frac{n_2}{n_1} \right\rfloor \text{ and } r = n_2 \bmod n_1$$

In the formulas above $\lfloor\ \rfloor$ is the floor function, i.e. the integer part of the division of $n_1$ and $n_2$, while mod is the modulo function, i.e. the integer remainder of the division of $n_1$ and $n_2$.

In each loop of the iteration, the expression is expanded as follows:

If $n_1 > n_2$, $$(\ldots) = (r)((q+1) \cdot P_1 + P_2) + (n_2 - r)(q \cdot P_1 + P_2)$$

If $n_2 > n_1$, $$(\ldots) = (n_1 - r)(P_1 + q - \cdot P_2) + (r)(P_1 + (q+1)P_2)$$

For the next loop of the iteration, in case $n_1 > n_2$, (r) will be the new $n_1$ and $((q+1) \cdot P_1 + P_2)$ will be the new $P_1$, while $(n_2 - r)$ will be the new $n_2$ and $(q \cdot P_1 + P_2)$ will be the new $P_2$.

This iteration has to continue until either r, $n_1 - r$ or $n_2 - r$ equal to 1.

Inserting the previously defined example, wherein $n_1$=9, $P_1$=100%, $n_2$=25 and $P_2$=16%, this will become in the block notation 9·100%+25·16%.

In the first iteration, q=2 and r=7 and the block notation is determined to be $$\underbrace{(2)}_{n_1} \cdot \underbrace{(100\% + 2 \cdot 16\%)}_{P_1} + \underbrace{(7)}_{n_2} \cdot \underbrace{(100\% + 3 \cdot 16\%)}_{P_2}.$$

For the next iteration, (2) (former (q)) will be the new $n_1$ and (7) (former (r)) will be the new $n_2$, while the whole block (100%+2+16%) will be the new $P_1$ and (100%+3·16%) will be the new $P_2$.

In the next iteration step, q is determined to be 3 and r is determined to be 1. Therefore, the iteration stops and in block notation we will get $$(1) \cdot [(100\% + 2 \cdot 16\%) + (3) \cdot (100\% + 3 \cdot 16\%)] + (1) \cdot [(100\% + 2 \cdot 16\%) + (4) \cdot (100\% + 3 \cdot 16\%)]$$

Therefore, the complete pre-calculated pattern will be $$(100\% + 16\% + 16\%) + (100\% + 16\% + 16\% + 16\%) + (100\% + 16\% + 16\% + 16\%) + (100\% + 16\% + 16\% + 16\%) + (100\% + 16\% + 16\%) + (100\% + 16\% + 16\% + 16\%) + (100\% + 16\% + 16\% + 16\%) + (100\% + 16\% + 16\% + 16\%) + (100\% + 16\% + 16\% + 16\%)$$

For changing between different pre-calculated actuation patterns, it is in principle possible, to wait until a whole pattern has passed. However, in the case of relatively long actuation patterns, this can take some time.

Therefore, it is suggested to use the concept of a transition variable. For this, an accumulator variable can be used. After every time step, the fluid flow demand is added to the accumulator. If a pumping stroke is performed, the accumulator will be decreased by the amount of volume, that was pumped in the respective time step.

In tables 1 and 2, the development of demand, actual pumping and the contents of the accumulator is shown as an example for different flow demands. For brevity, the tables are not showing the complete cycle.

The accumulator can be used for a transition between two different actuation patterns. If the demand is changed, the present actuation cycle will be left early, for example at step 6 (see table 1). Here, the value of the accumulator is −7%. Now the follow-up actuation pattern is searched for an accumulator value, which is equal to −7% as well (or at least comes close to said value). Therefore, the follow-up actuation pattern will normally start somewhere in the middle. In the example of table 2, step 4 as an entry point could be used, because the value of the accumulator in the preceding step 3 is −10% and therefore very close to the −7%. By doing that, because the accumulator values are close to each other or are even the same, a relatively smooth transition can be provided.

The above description was mainly intended to show how an actuation pattern can be determined, even if only two single volume pumping fractions are allowed.

However, limiting the method to only two different volume fractions is an unnecessary limitation for pre-calculating actuation patterns. It is preferred to allow the volume fractions to be chosen out of a certain interval, or even out of the whole range from 0 to 100% volume pumping fraction.

For example, if the actual value of the two allowed pumping volume fractions is allowed to vary between 0% and 16.7% and 83.3% to 100% by choosing an appropriate (varying) firing angle, a serious reduction in the length of the actuation patterns can be obtained, and still a fluid flow demand between 0% and 100% can be satisfied. This is shown in FIG. 5.

Figure 5:
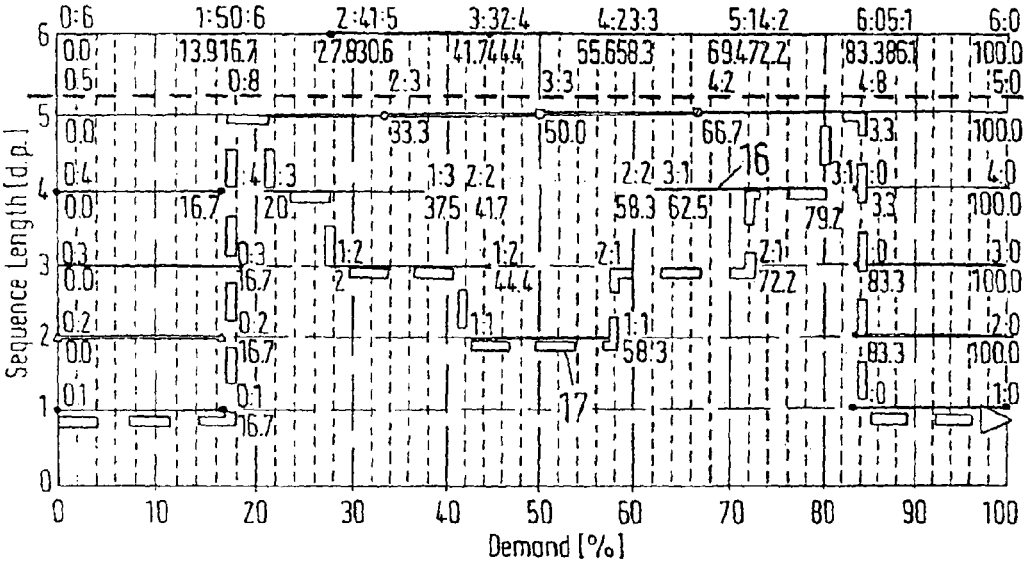
FIG. 5: shows the necessary minimum length of actuation patterns for a narrow interval of continually modulated part stroke pulses.

Within FIG. 5, several intervals 16 are depicted, where every interval 16 stands for a certain fixed ratio of the number of pumping strokes to be performed. I.e., a ratio 1:3 means that there are three part stroke pumping pulses in the interval from 0% to 16.7% and one pumping stroke in the interval from 83.3% to 100%. It can be seen, that there is quite some overlap between different intervals 16. Furthermore, a dashed line 17 is depicted in FIG. 5. This dashed line 17 shows the minimum length of an actuation pattern that can supply a certain fluid flow demand. And in this example, the figure shows that the entire demand range from 0% to 100% can be satisfied by sequences with a maximum length of only 5 decision points.

Figure 6:
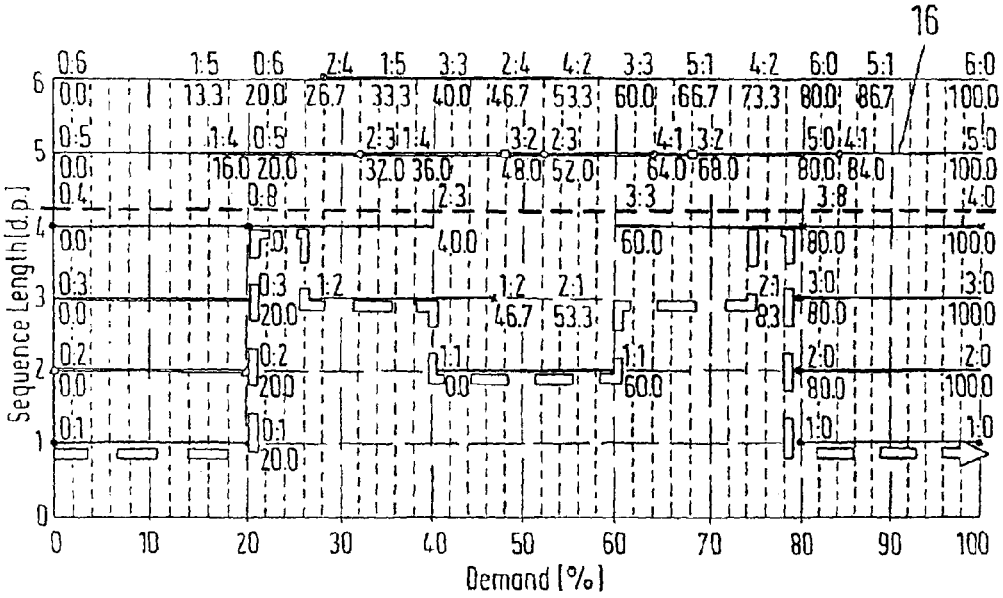
FIG. 6: shows the necessary minimum length of actuation patterns for a wider interval of continually modulated part stroke pulses.

If the limitations for the volume pumping fraction are relaxed, the sequence length of a pumping sequence, comprising a combination of individual pumping strokes, can be further shortened. In FIG. 6 the allowed part stroke fractions lie in the interval from 0 to 20% and from 80% to 100%. Now, the individual intervals 16 become longer and the overlap regions increase accordingly. The maximum sequence length is now only 4 decision points.

Specific part stroke fractions of significance in defining the limits, which could be used particularly in this context, are ⅓, ⅔, ¼, ¾, ⅕, ⅘, ⅙, ⅚, and so on $$\left(\text{i.e. } \frac{1}{n} \text{ and } \frac{n-1}{n} \text{ for } n = 3, 4, \ldots\right).$$

Once again it has to be noted, that by introducing more than just two allowed pumping volume fractions, the sequence length could be even further reduced.

In principle, the allowed intervals for the pumping volume fraction can be chosen to be even wider. However, as already mentioned, in the region around 50%, the fluid speed, leaving the working chamber through the inlet valve is very high. If the valve is closed at this point, unnecessary noise could be generated and even the stress and consequently the wear of the valve could be increased.

Additional information can be drawn from the three other applications, filed on the same day by the same applicant under EP Application Serial No. 07254337.4, EP Application Serial No. 07254332.5 and EP Application Serial No. 07254333.3. The content of said applications is included into the disclosure of this application by reference. Also, U.S. application Ser. No. 12/261,390 is incorporated by reference herein.

While the present invention has been illustrated and described with respect to a particular embodiment thereof, it should be appreciated by those of ordinary skill in the art that various modifications to this invention may be made without departing from the spirit and scope of the present.

TABLE 1

| Step | 0 | 1 | 2 | 3 | 4 | 5 | 6 |
|---|---|---|---|---|---|---|---|
| Demand | 0 | 25 | 25 | 25 | 25 | 25 | 25 |
| Pumping | 0 | 25 | 50 | 25 | 16 | 16 | 25 |
| Accumulator | 0 | 0 + 25 − 25 = 0 | 0 + 25 − 50 = −25 | −25 + 25 − 25 = −25 | −25 + 25 − 16 = −16 | −16 + 25 − 16 = −7 | −7 + 25 − 25 = −7 |

| Step | 7 | 8 | 9 | 10 | 11 |
|---|---|---|---|---|---|
| Demand | 25 | 25 | 25 | 25 | 25 |
| Pumping | 50 | 25 | 16 | 16 | 16 |
| Accumulator | −7 + 25 − 50 = −32 | −32 + 25 − 25 = −32 | −32 + 25 − 16 = −23 | −23 + 25 − 16 = −14 | −14 + 25 − 16 = −5 |

TABLE 2

| Step | 0 | 1 | 2 | 3 | 4 | 5 | 6 |
|---|---|---|---|---|---|---|---|
| Demand | 0 | 30 | 30 | 30 | 30 | 30 | 30 |
| Pumping | 0 | 25 | 25 | 50 | 16 | 16 | 50 |
| Accumulator | 0 | 0 + 30 − 25 = +5 | +5 + 30 − 25 = 10 | +10 + 30 − 50 = −10 | −10 + 30 − 16 = +4 | 4 + 30 − 16 = 18 | 18 + 30 − 50 = −2 |

What is claimed is:

1. A method of operating a fluid working machine, comprising at least one working chamber of cyclically changing volume, a high-pressure fluid connection, a low-pressure fluid connection and at least one electrically actuated valve connecting said working chamber to said high-pressure fluid connection and/or said low-pressure fluid connection, wherein the actuation of at least one of said electrically actuated valves is chosen depending on the fluid flow demand, wherein the actuation pattern of said electrically actuated valve is chosen from a stored set of a plurality of pre-calculated actuation patterns.

2. The method according to claim 1, wherein a fluid flow demand, lying between two pre-calculated actuation patterns, is provided by interpolating between said two actuation patterns.

3. The method according to claim 1, wherein a fluid flow demand lying between two pre-calculated actuation patterns, is provided by modifying at least one actuation angle from its stored value.

4. The method according to claim 1, wherein the transition between different actuation patterns is done at least partially at the end of the previous actuation pattern.

5. The method according to claim 1, wherein the transition between different actuation patterns is done at least partially during the execution of the previous actuation pattern.

6. The method according to claim 4, wherein the following actuation pattern is started from a position in-between said following actuation pattern.

7. The method according to claim 4, wherein a transition variable is used, being indicative of the smoothness of the transition between the different actuation patterns.

8. The method according to claim 1, wherein two or more different pumping/motoring fractions are used.

9. The method according to claim 1, wherein in the actuation patterns certain part-stroke volume fractions are excluded.

10. The method according to claim 1, wherein the distribution of the pumping/motoring strokes within an actuation pattern is arranged in a way, that a smooth fluid flow output during the execution of said actuation pattern is supported.

11. The method according to claim 1, wherein the time-dependant fluid output flow of the individual pumping/motoring strokes is considered for the pre-calculated actuation patterns.

12. A fluid working machine, comprising at least one working chamber of cyclically changing volume, a high-pressure fluid connection, a low-pressure fluid connection, at least one electrically commutated valve, connecting said working chamber to said high-pressure fluid connection and/or said low-pressure fluid connection and at least an electronic controller unit, wherein the electronic controller unit is designed and arranged in a way that said electronic controller unit performs a method according to claim 1.

13. The fluid working machine according to claim 12 wherein at least a memory device storing at least one pre-calculated actuation pattern.

14. A memory device, storing at least one pre-calculated actuation pattern for performing a method according to claim 1.

* * * * *